US005797374A

United States Patent [19]

Minagawa et al.

[11] Patent Number: 5,797,374

[45] Date of Patent: Aug. 25, 1998

[54] FUEL SUPPLY APPARATUS FOR ENGINES

[75] Inventors: Kazuji Minagawa, Tokoname; Kiyotoshi Oi, Toyohashi, both of Japan

[73] Assignee: Nippondenso Co., Ltd., Kariya, Japan

[21] Appl. No.: 694,065

[22] Filed: Aug. 8, 1996

[30] Foreign Application Priority Data

Aug. 9, 1995 [JP] Japan ..... 7-203225

[51] Int. Cl.[6] ..... F02M 37/04

[52] U.S. Cl. ..... 123/497; 123/456; 123/198 DB

[58] Field of Search ..... 123/497, 456, 123/458, 463, 198 DB

[56] References Cited

U.S. PATENT DOCUMENTS

| | | | |
|---|---|---|---|
| 4,653,528 | 3/1987 | Field et al. . | |
| 4,807,583 | 2/1989 | Thornwaite | 123/198 DB |
| 5,052,359 | 10/1991 | Hardwick et al. . | |
| 5,163,472 | 11/1992 | Takada | 123/447 |
| 5,181,494 | 1/1993 | Ausman et al. . | |
| 5,284,119 | 2/1994 | Smitley . | |
| 5,327,872 | 7/1994 | Morikawa . | |
| 5,361,742 | 11/1994 | Briggs et al. . | |
| 5,379,741 | 1/1995 | Matysiewicz et al. . | |
| 5,385,170 | 1/1995 | Tonhauser | 123/198 DB |
| 5,398,655 | 3/1995 | Truckey | 123/497 |
| 5,413,077 | 5/1995 | Hornby et al. . | |
| 5,448,977 | 9/1995 | Smith et al. . | |
| 5,458,104 | 10/1995 | Tuckey | 123/463 |
| 5,509,390 | 4/1996 | Tuckey . | |
| 5,524,592 | 6/1996 | Woody | 123/198 DB |
| 5,542,395 | 8/1996 | Tuckey . | |
| 5,558,063 | 9/1996 | Minagawa et al. . | |
| 5,590,631 | 1/1997 | Tuckey | 123/447 |

FOREIGN PATENT DOCUMENTS

A-7-27029 1/1995 Japan .

*Primary Examiner*—Carl S. Miller
*Attorney, Agent, or Firm*—Nixon & Vanderhye, PC

[57] ABSTRACT

A pressure control valve includes a downstream pressure control valve disposed between a fuel pipe and a fuel rail. An opening-closing valve can be integrally formed with the downstream pressure control valve. A relief valve can be disposed to bypass the downstream pressure control valve. The downstream pressure control valve opens or closes the fuel passage leading to the fuel rail so that fuel pressure in the fuel rail is maintained at a predetermined value. When the engine is stopped, the fuel passage is closed to decrease leakage of fuel from the fuel injector. When the fuel pump is again operated, the by-pass relief valve is opened by the pressure of fuel in the fuel pipe. Thus, fuel is supplied from an upstream side to a downstream side and fuel pressure in the fuel rail is increased rapidly for engine re-start.

15 Claims, 9 Drawing Sheets

FUEL SUPPLY APPARATUS FOR ENGINES

CROSS-REFERENCE TO RELATED APPLICATIONS

This application is related to and claims priority from Japanese Patent Application No. 7-203225, the contents of which are hereby incorporated by reference. This application is also related to copending commonly assigned application Ser. No. 08/700,868 filed Aug. 21, 1996.

BACKGROUND OF THE INVENTION

1. Field of the Invention

The present invention relates to a fuel supply apparatus for an internal combustion engine, more particularly to a fuel supply apparatus for supplying fuel into a fuel rail and or the like by a fuel pump.

2. Description of Related Art

Conventionally, in a fuel supply apparatus for injecting fuel into an intake port of an internal combustion engine, fuel pumped from a fuel tank by a fuel pump is directed to a fuel rail through a fuel pipe, then the fuel is injected and supplied to the intake port from a fuel injector located in the fuel rail so as to correspond to each cylinder. Further, in this fuel supply apparatus, to keep the pressure of fuel supplied to the fuel injector to a predetermined pressure, a pressure regulator is located in the fuel rail and a return pipe for returning surplus fuel into the fuel tank is also located.

In fuel supply apparatus having the return pipe, since the fuel rail is placed near the engine, the fuel rail is heated to a high temperature so that the temperature of fuel contained in the rail is increased. Therefore, the surplus fuel returned into the fuel tank from the return pipe is of increased temperature and serves to heat fuel in the fuel tank and a large amount of evaporative emission is generated. Further, such conventional fuel supply apparatus needs the return pipe, so that the cost becomes high.

Further, a return-less fuel supply apparatus without the return pipe for returning the surplus fuel of the fuel rail or the like to the fuel tank has been proposed in JP-A-7-27029.

In this return-less system, an in-tank type fuel pump is used. A pressure control valve (downstream pressure control valve) is located in a fuel supply passage between the fuel tank and the fuel rail. When the pressure of the fuel supply passage reaches a predetermined pressure, the downstream pressure control valve closes the fuel passage. Further, a pressure regulating device which operates with a little higher pressure than the pressure controlled by the downstream pressure control valve is located in the fuel pump body. By the pressure regulating device, the surplus fuel is directly returned into the fuel tank, so that the return pipe is not needed.

Recently, the decrease of harmful exhaust gas is in high demand. To decrease HC gas in the harmful exhaust gas, it is more effective to decrease leakage of fuel from the fuel injector to the intake port.

However, in the above-described various fuel supply apparatuses, to prevent the leakage of fuel from the fuel injector, watertight contact of the valve portion of the fuel injector itself is necessary, so that extremely accurate machining is necessary. Thus, it is not easy to achieve this desired result in view of the difficulty of the manufacturing process and/or the cost or the like. Further, when the fuel pressure is reduced to prevent leakage of fuel, vapor is easily generated so that startability is deteriorated.

SUMMARY OF THE INVENTION

In view of the foregoing problems, it is an object of the present invention to provide a fuel supply apparatus for an internal combustion engine which can decrease the leakage of fuel from a fuel injector without deteriorating startability.

According to the present invention, fuel is pressurized and supplied to a fuel rail through a fuel supply passage by a fuel pump, and further, the fuel supplied from the fuel rail is injected from a fuel injector. During operation of the engine, fuel pressure in the fuel rail is controlled to a predetermined value by a control valve. When the engine is stopped, fuel pressure in the fuel rail is gradually decreased by fuel leaking from the fuel injector. Thus a downstream side including the fuel rail and an upstream side of the fuel rail are separated by closing an opening-closing valve according to the decrease of fuel pressure in the fuel rail. That is, when the engine is stopped, the opening-closing valve closes the fuel supply passage according to the decrease of fuel pressure in the fuel rail, so that the downstream side including the fuel rail and the upstream side of the fuel rail are separated by the opening-closing valve. Therefore, even if fuel is leaked from the fuel injector after the fuel supply passage is closed, the leaked fuel amount is restricted to the amount of fuel in the fuel rail (that is, the downstream side of the opening-closing valve). Thus, the amount of fuel leaking toward an intake port becomes small, the generation of HC gas is decreased when the engine is restarted, and emissions in the exhaust gas can be greatly decreased. The opening-closing valve can be disposed between the fuel rail and the fuel supply passage or in the fuel supply passage near the fuel rail, however, when the opening-closing valve is disposed near the fuel rail, the amount of fuel leaking from the fuel injector becomes smaller.

Preferably, the opening-closing valve may be integrally formed with a valve member of the control valve which opens and closes the fuel supply passage. Thus, structures of the control valve and the opening-closing valve can be simplified.

According to the present invention, a relief valve releasing fuel pressure of fuel from the upstream side to the downstream side (fuel rail side) may be located in a fuel passage bypassing the control valve. In this way, when fuel having a high pressure is supplied to the fuel supply passage by the fuel pump in re-starting the engine, the fuel is rapidly supplied to the fuel rail through the relief valve, and therefore, fuel injection can be more rapidly started.

Further, when the fuel pressure introduced into the downstream side through the relief valve reaches a predetermined value, the opening-closing valve is opened. After the opening-closing valve is opened, the pressure of fuel in the fuel rail is controlled by the control valve.

Still further, when the engine is operated, the fuel pressure in the fuel rail (the downstream side pressure) is controlled to a predetermined value by the control valve. When a signal indicative of stopping the engine is detected by stop detecting means, the opening-closing valve is operated by valve control means, so that the fuel supply passage is closed and the downstream side (fuel rail side) and the upstream side of the fuel rail are separated. That is, when the engine is stopped, the pressure of fuel in the fuel rail is gradually decreased by fuel leaking from the fuel injector, however, the opening-closing valve is closed at this time, so that the upstream side and the downstream side are separated by the opening-closing valve. Therefore, even if fuel is leaked from the fuel injector after the fuel passage is closed, the leaking fuel amount is nearly restricted to the decreased fuel amount in the fuel rail at most. Thus, the amount of fuel leaking to the intake port becomes small, the generation of HC gas is decreased in re-starting, and emissions in the exhaust gas can be greatly decreased.

Further, as the stop detecting means for detecting the stop state of the engine, a stop state such as a stop position of the ignition key indicative of the stop state of the engine may be electrically detected, however, other detecting means such as detecting the increase of intake pressure when the engine is stopped may be used. Therefore, as the valve control means for driving the opening-closing valve, various methods, including means for electrically driving the opening-closing valve or means employing change of the intake pressure or the like, may be used.

Still further, the opening-closing valve may be an electromagnetic valve which is electrically operated by a control unit such as a computer.

Moreover, a check valve for closing the fuel passage at the discharge side of the fuel pump when the engine is stopped may be provided within the fuel pump. Therefore, even if fuel is leaked from the fuel injector so that fuel of the upstream side (that is, in the fuel rail) of the opening-closing valve becomes zero when the engine is stopped, fuel is held in the fuel supply passage from the check valve to the opening-closing valve. Thus, it is not necessary to fill the fuel supply passage with fuel in re-starting, fuel can be rapidly supplied to the fuel rail.

BRIEF DESCRIPTION OF THE DRAWINGS

Additional objects and advantages of the present invention will be more readily apparent from the following detailed description of preferred embodiments thereof when taken together with the accompanying drawings in which:

FIG. 4A is a cross-sectional view taken along the IVA—IVA line of FIG. 4B;

DETAILED DESCRIPTION OF PRESENTLY PREFERRED EXEMPLARY EMBODIMENTS

Preferred embodiments of the present invention are described hereinafter with reference to the accompanying drawings.

A first embodiment of the present invention will be described.

Figure 1:
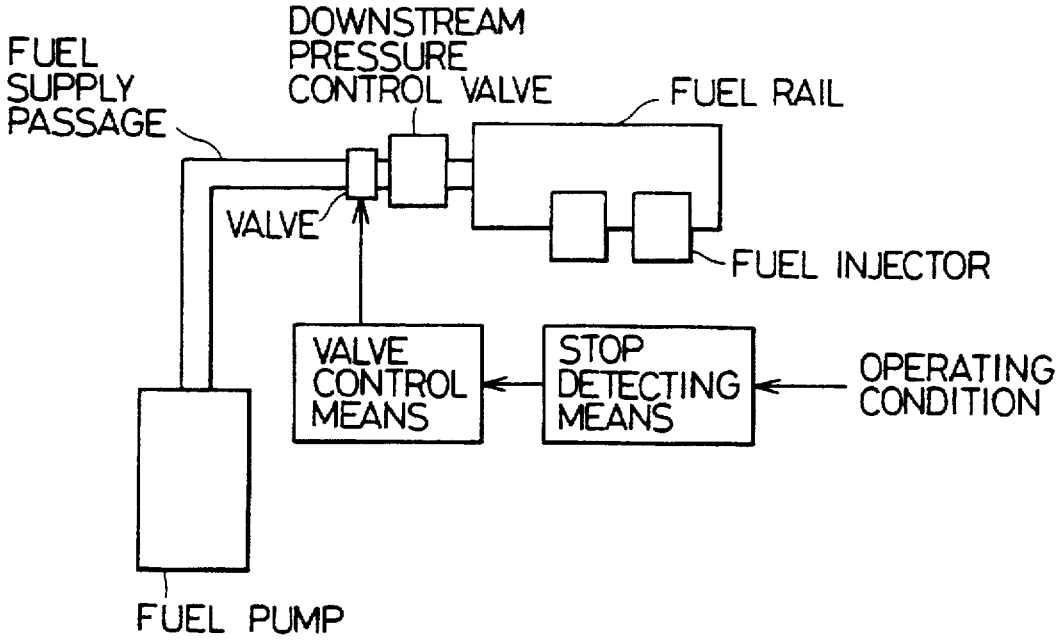
FIG. 1 is a schematic block diagram showing the construction of a fuel supply apparatus according to a first embodiment of the present invention.
Figure 2:
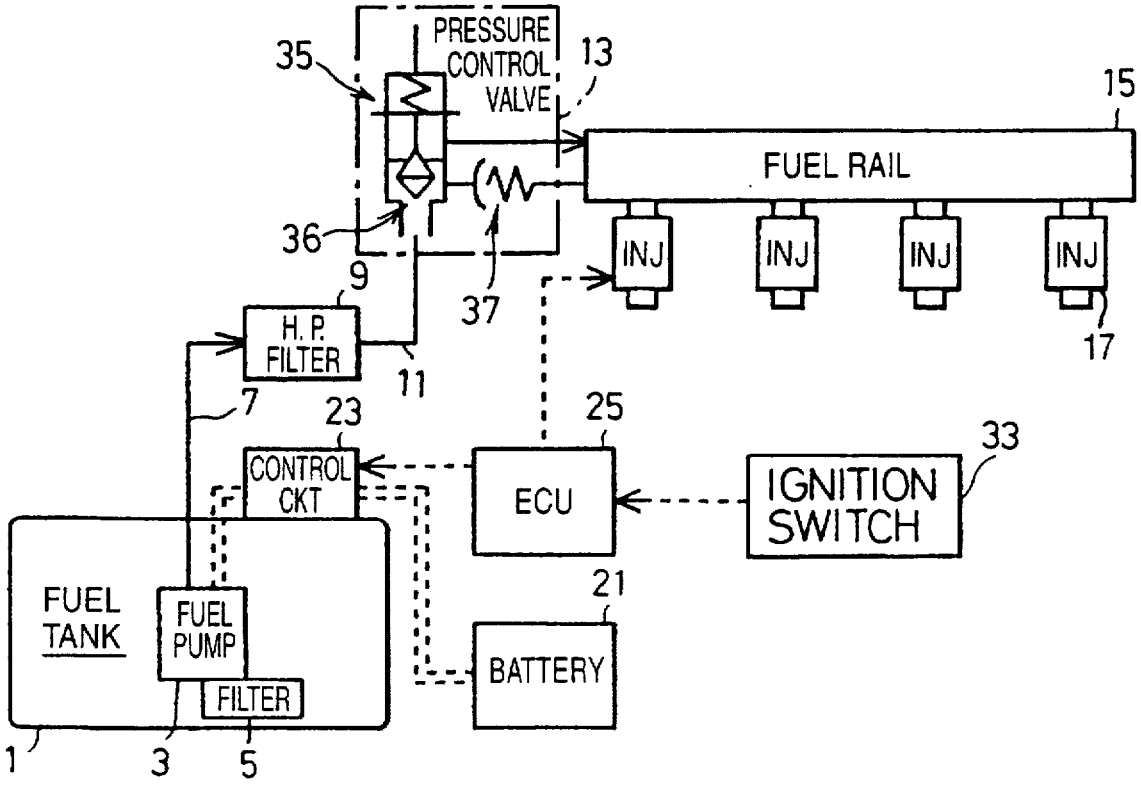
FIG. 2 is a system diagram showing the construction of the fuel supply apparatus for an engine according to the first embodiment.

FIG. 2 shows a system diagram of the construction of the fuel supply apparatus for an internal combustion engine (hereinafter referred to as a fuel supply apparatus) according to the first embodiment.

As shown in FIG. 2, the fuel supply apparatus includes a fuel pump 3 located in a fuel tank 1, a low-pressure fuel filter 5 connected to a suction side of the fuel pump 3, a high-pressure fuel filter 9 connected to a discharge side of the fuel pump 3 through a fuel pipe 7, a pressure control valve 13 connected to an outlet side of the high-pressure fuel filter 9 through a fuel pipe 11, a fuel rail 15 located at a downstream side of the pressure control valve 13, fuel injectors 17 located in the fuel rail 15, the number of which corresponds to that of cylinders, for injecting and supplying fuel to an intake port of the internal combustion engine (not shown), a constant current type control circuit 23 which controls the electric power supplied from a battery 21 to the fuel pump 3 by an electric current control, and an electronic control unit 25 (ECU) for controlling the fuel injectors 17 and the constant current type control circuit 23 and the like.

The ECU 25 includes a ROM, a RAM, a back up RAM, a CPU, an input-output portion, and a bus line for connecting these components, (which are not shown). In the input-output portion, a signal from an ignition switch 33 indicative of an operation state of an ignition key is input to detect a stop state of the engine, for example. Further, the constant current type control circuit 23 and the fuel injector 17 are connected to the input-output portion so that the control signals are output to the constant current type control circuit 23 and the fuel injector 17.

Because the above-described fuel supply apparatus is a return-less system, a return pipe for returning fuel from the fuel rail 15 or the like to the fuel tank 1 is not used. Therefore, in the first embodiment, by the constant current type control circuit 23, current supplied to a pump motor (direct current electric motor) of the fuel pump 3 is controlled to maintain a predetermined fuel pressure in the fuel rail 15 according to the fuel injection amount from the fuel rail 15.

Since the fuel pump 3 cooperates with the engine, the fuel pump 3 stops when the engine is stopped. However, when the fuel pump 3 stops, a check valve (not shown) located on a discharge side of the fuel pump 3 is driven to close the passage of fuel.

Next, a structure of the pressure control valve 13, which is one of main features of the first embodiment in the above system will be described.

The pressure control valve 13 is composed of a downstream pressure control valve 35 located between the fuel pipe 11 and the fuel rail 15, an opening-closing valve 36 which is integrally formed with the downstream pressure control valve 35, and a relief valve 37 located in a passage bypassing the downstream pressure control valve 35.

The downstream pressure control valve 35 operates according to a negative pressure introduced from an intake manifold, a spring pressure and the fuel pressure (described later). The downstream pressure control valve 35 opens and closes the fuel passage leading from the fuel pipe 11 to the fuel rail 15 so that the pressure (downstream pressure) of fuel in the fuel rail 15 is set to a predetermined pressure.

Further, the opening-closing valve 36 closes the fuel passage of the fuel pipe 11 according to the decrease of the pressure when the engine is stopped so that fuel from the fuel injector 17 is leaked and the pressure of fuel in the fuel rail 15 is decreased (described later). The opening-closing valve 36 is integrally formed within the downstream pressure control valve 35.

Further, the relief valve 37 opens by the fuel pressure of the fuel pipe 11 on an upstream side when the fuel pump 3 is operated (described later). By opening the relief valve 37, fuel is supplied from an upstream side to an downstream side, and the pressure of fuel in the fuel rail 15 is increased.

Next, structures of the downstream pressure control valve 35 and the opening-closing valve 36 as well as the relief valve 37 will be described with the entire structure of the pressure control valve 13.

Figure 3:
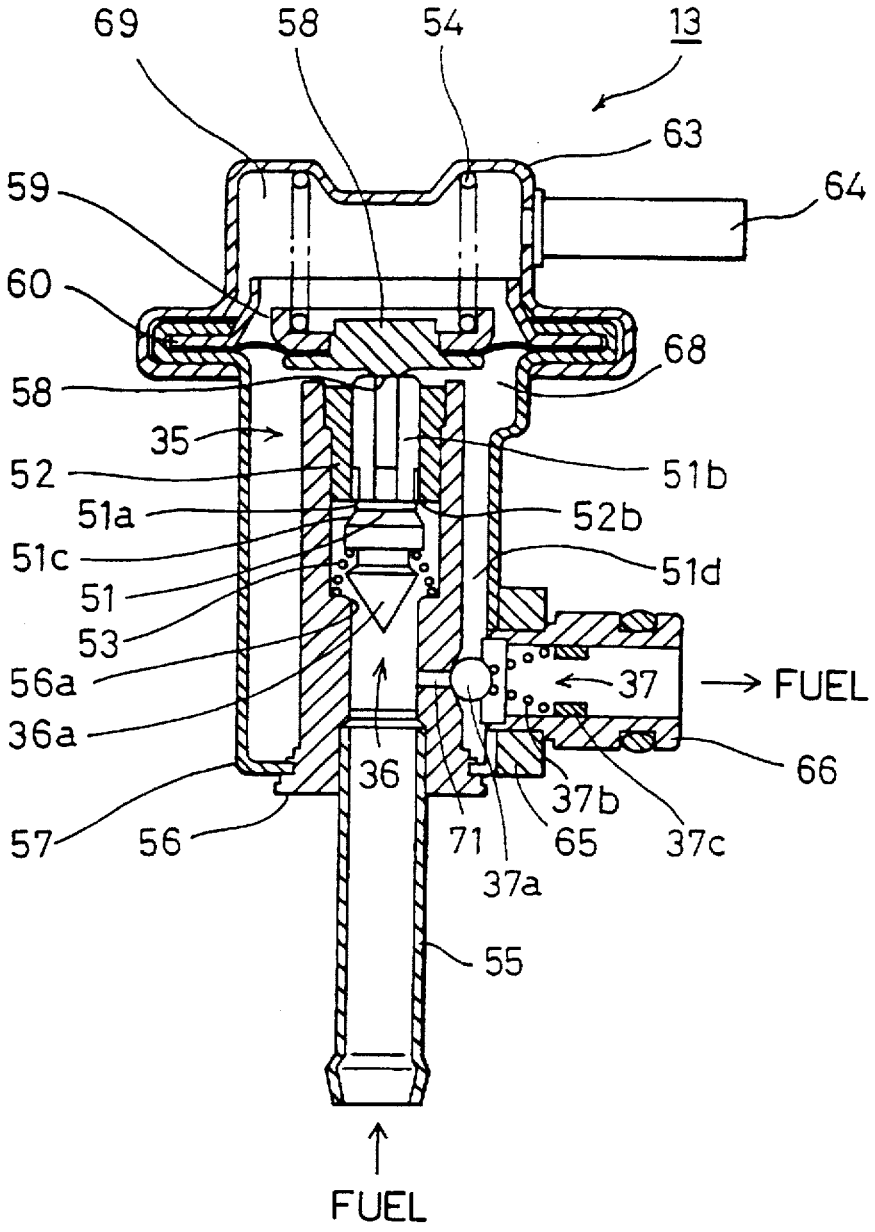
FIG. 3 is a sectional view showing a pressure control valve of the first embodiment.

As shown in FIG. 3, in the pressure control valve 13, a diaphragm 60 is fixedly seamed in the boundary between a body 57 and a cover 63. The center portion of the diaphragm 60 is held by a valve presser 58 and a lower sheet 59, the diaphragm 60 and the valve presser 58 as well as the lower sheet 59 are integrally reciprocated. The lower sheet 59 is biased toward a diaphragm lower room 68 (downward direction in FIG. 3) by the compression coil spring 54 placed between the inner wall of the cover 63 and the lower sheet 59.

A diaphragm upper room 69 accommodating the compression coil spring 54 is connected to the intake manifold by a pipe 64. The inside pressure of the diaphragm upper portion room 69 is set by the negative pressure within the intake manifold.

Further, a pipe 55 connected with the fuel pipe 11 is connected to the body 57 through a cylindrical connector 56. A connector 66 which can be installed in the fuel rail 15 is installed in the body 57 by a flange 65. Further, the connector 56 having the pipe 55 on one end side thereof is accommodated in the diaphragm lower room 68 formed within the body 57. A cylindrical valve body 52 and a valve member 51 having an inside guide **51*b* sliding in the valve body 52 are accommodated in the connector 56. The valve member 51 is biased in the valve closing direction (the upper direction in FIG. 3) by the compression coil spring 53 accommodated in the connector 56**.

Figure 4A:
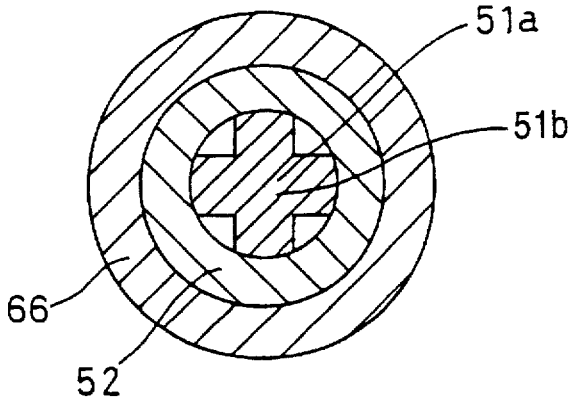
FIG. 4A and FIG. 4B are cross sectional views showing a main portion of the pressure control valve of the first embodiment.
Figure 4B:
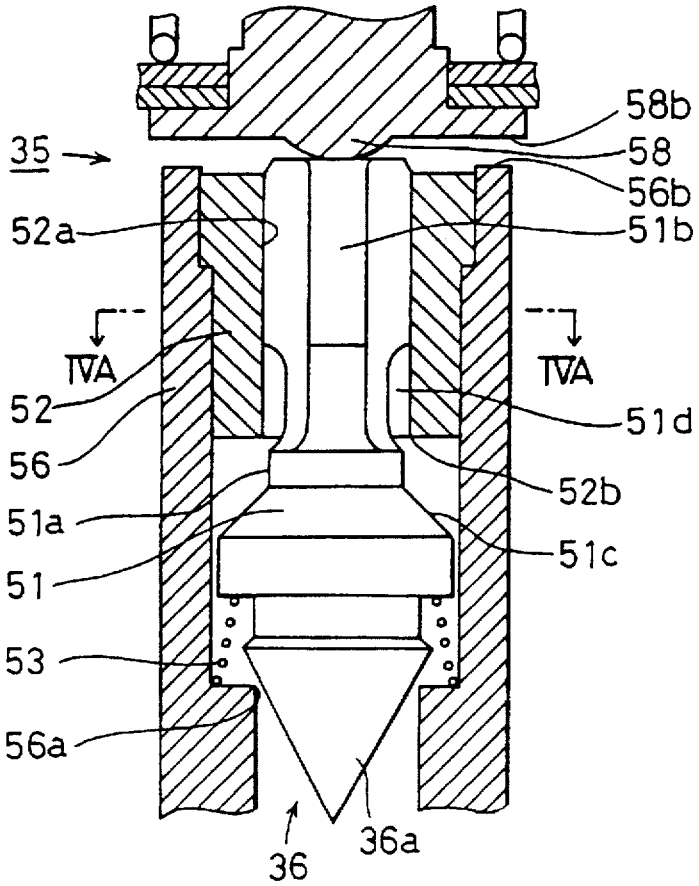

As shown in FIGS. 4A–4B, the valve member 51 includes a taper shaped contacting portion **51*c* which is tapered off toward the inside guide 51*b* side and a cylindrical spool 51*a* between the contacting portion 51*c* and the inside guide 51*b*. The outer diameter of the spool 51*a* is slightly smaller than the inner diameter of the valve body 52. The cross section of the inside guide 51*b* in the radial direction is formed in a cross shape. Further, a recess portion 51*d* is formed near a connecting portion between the inside guide 51*b* and the spool 51*a***.

In the first embodiment, the downstream pressure control valve 35 is mainly constituted as described above, more specifically, the opening-closing valve 36 is integrally formed with the downstream pressure control valve 35.

That is, a conical valve member **36*a* of the opening-closing valve 36 which is tapered off toward the top end side is integrally formed with the top end portion (lower side in FIG. 4B) of the valve member 51, and a valve seat 56*a* which contacts with the valve member 36*a* is located within the connector 56. That is, the opening-closing valve 36 consists of the valve member 36*a* and the valve seat 56*a*. Thus, the fuel passage is opened or closed by the opening-closing valve 36 together with the operation of the valve member 51 of the downstream pressure control valve 35**.

Figure 5:
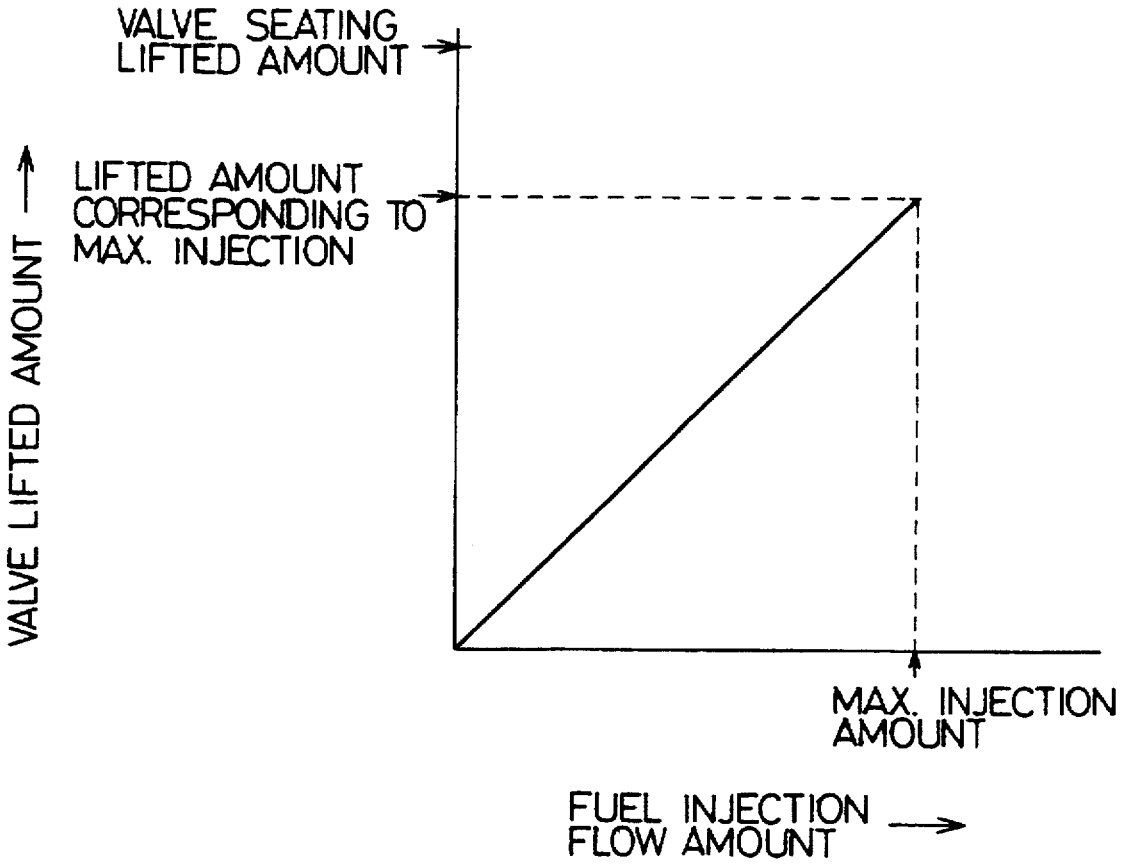
FIG. 5 is a graph showing a relationship between a lifted amount of an opening-closing valve and a fuel injection flow amount.

As shown in FIG. 5, when the lifted amount (the moving amount in the down direction in FIG. 4B) of the opening-closing valve is increased, the fuel injection flow amount is increased. However, when the opening-closing valve 36 is seated before the fuel injection flow amount becomes the maximum injection flow amount, the necessary amount of fuel for controlling the engine cannot be injected. Therefore, the maximum lifted amount (seat lifted amount) is set sufficiently high that the opening-closing valve 36 is not seated before the maximum injection flow amount. Further, as shown in FIG. 4B, the reciprocating distance between a valve member side end surface **58*b* of the valve presser 58 and a valve presser side end surface 56*b* of the connector 56 is set to be larger than that between the valve member 36*a* and the valve seat 56*a***.

Further, as shown in FIG. 3, the relief valve 37 is located so as to bypass the downstream pressure control valve 35. That is, a connecting passage (bypass passage 71) is located on the wall surface of the connector 56 so that the pipe 55 on an upstream side of the opening-closing valve 36 and the connector 66 on a downstream side of the opening-closing valve 36 are connected with each other, and the relief valve 37 is so disposed as to open or close the bypass passage 71 at the side of the connector 66 (at the side of fuel rail 15). Specifically, the relief valve 37 consists of a valve body **37*a* which is seated at or lifted from the opening portion of the bypass passage 71 for opening or closing the bypass passage 71, a compression coil spring 37*b* biasing the valve body 37 in the valve closing direction (the left direction in FIG. 3), and an engaging member 37*c* for engaging the compression coil spring 37*b***.

Next, with reference to FIGS. 2, 3 and 6, an operation of the system will be described together with the operation of the pressure control valve 13.

As shown in FIG. 2, in the above-described system, when fuel is pumped by the fuel pump 3 located in the fuel tank 1, extraneous materials in the fuel are removed by the low pressure fuel filter 5, and the fuel pumped by the fuel pump 3 is sent to the high pressure fuel filter 9 through the fuel pipe 7. Then, minute extraneous materials, water and the like in the fuel are removed in the high pressure fuel filter 9, the filtered fuel is supplied to the fuel rail 15 through the fuel pipe 11 and the pressure control valve 13. The high pressure fuel supplied to the fuel rail 15 is injected from the fuel injector 17 to the intake port of the engine.

As shown in FIG. 3, in the pressure control valve 13, when the differential pressure between the diaphragm upper room 69 and the diaphragm lower room 68 becomes larger than a predetermined pressure, the contacting portion **51*c* of the valve member 51 is contacted with the valve seat 52*b* of the valve body 52 so as to be closed. When the pressure of fuel is lowered to a target fuel pressure value by injecting fuel or the like, the contacting portion 51*c* of the valve member 51 is lifted from the valve seat 52*b* of the valve body 52 so as to be opened. Thus, the pressure of fuel in the fuel rail 15 located at a downstream side of the pressure control valve 13** is maintained to a constant value.

That is, the position of the valve presser 58 is changed by a balance among the pressure of fuel in the diaphragm upper room 69 (intake manifold pressure), the pressure of fuel directed into the diaphragm lower room 68 (the pressure of fuel in the fuel rail 15), the spring force in the valve opening direction of the compression coil spring 54 accommodated within diaphragm upper room 69, and the spring force in the valve closing direction of the compression coil spring 53. By the displacement of the valve presser 58, the valve member 51 contacted with the valve presser 58 is moved to the valve opening direction or the valve closing direction.

Specifically, by injecting fuel or the like, the high pressure fuel in the diaphragm lower room 68 is discharged through the fuel rail 15, further, the pressure of fuel in the diaphragm lower room 68 is decreased, whereby the sum of the pressure in the diaphragm upper room 69 and the spring force of the compression coil spring 54 becomes larger than the sum of the pressure of fuel in the diaphragm lower room 68 and the spring force of the compression coil spring 53. Therefore, the valve presser 58 is moved in the opening direction, and the valve member 51 pressed by the valve presser 58 is moved so that the valve is opened. Further, by opening valve, the pressure of fuel in the diaphragm lower room 68 is gradually increased, whereby the sum of the pressure in the diaphragm upper room 69 and the spring force of the compression coil spring 54 becomes smaller than the sum of the pressure of fuel in the diaphragm lower room 68 and the spring force of the compression coil spring 53. Therefore, the valve presser 58 is moved in the valve closing direction, and the valve member 51 is moved by the spring force of the compression coil spring 53 so as to be opened.

In the operation of the above-described system, when fuel supplied from the fuel pipe 11 to the pressure control valve 13 flows into the connector 56 through the pipe 55, the contacting portion 51*c* of the valve member 51 is lifted from the valve seat 52*b* of the valve body 52, if the fuel is in a pressure state where the valve member 51 is open, the fuel flows into the recess portion 51*d* of the valve member 51 through the fuel passage formed between the contacting portion 51*c* and valve seat 52*b*. Then, the fuel flowing into the recess portion 51*d* passes through the inside guide 51*b* in the valve member 51, flows into the diaphragm lower room 68, and is supplied into the fuel rail 15 through the connector 66.

Then, when the pressure of fuel in the fuel rail 15 is increased by the supplied fuel and the fuel is in a pressure state where the valve member 51 is closed, the contacting portion 51*c* of the valve member 51 is lifted from the valve seat 52*b* of the valve body 52 so as to be closed.

Thus, by opening and closing the valve member 51, the pressure of fuel in the fuel rail 15 is maintained to a predetermined value during the normal fuel injection.

In the above-described normal operation, when the engine is stopped, the fuel pump 3 stops, and therefore, fuel is not supplied and the check valve of fuel pump 3 closes the fuel passage. Thus, fuel does not flow back toward the fuel pump 3, the pressure of fuel in the fuel pipes 7 and 11 or the fuel rail 15 is maintained to the value where the fuel pump 3 stops (immediately after the engine is stopped).

Figure 6:
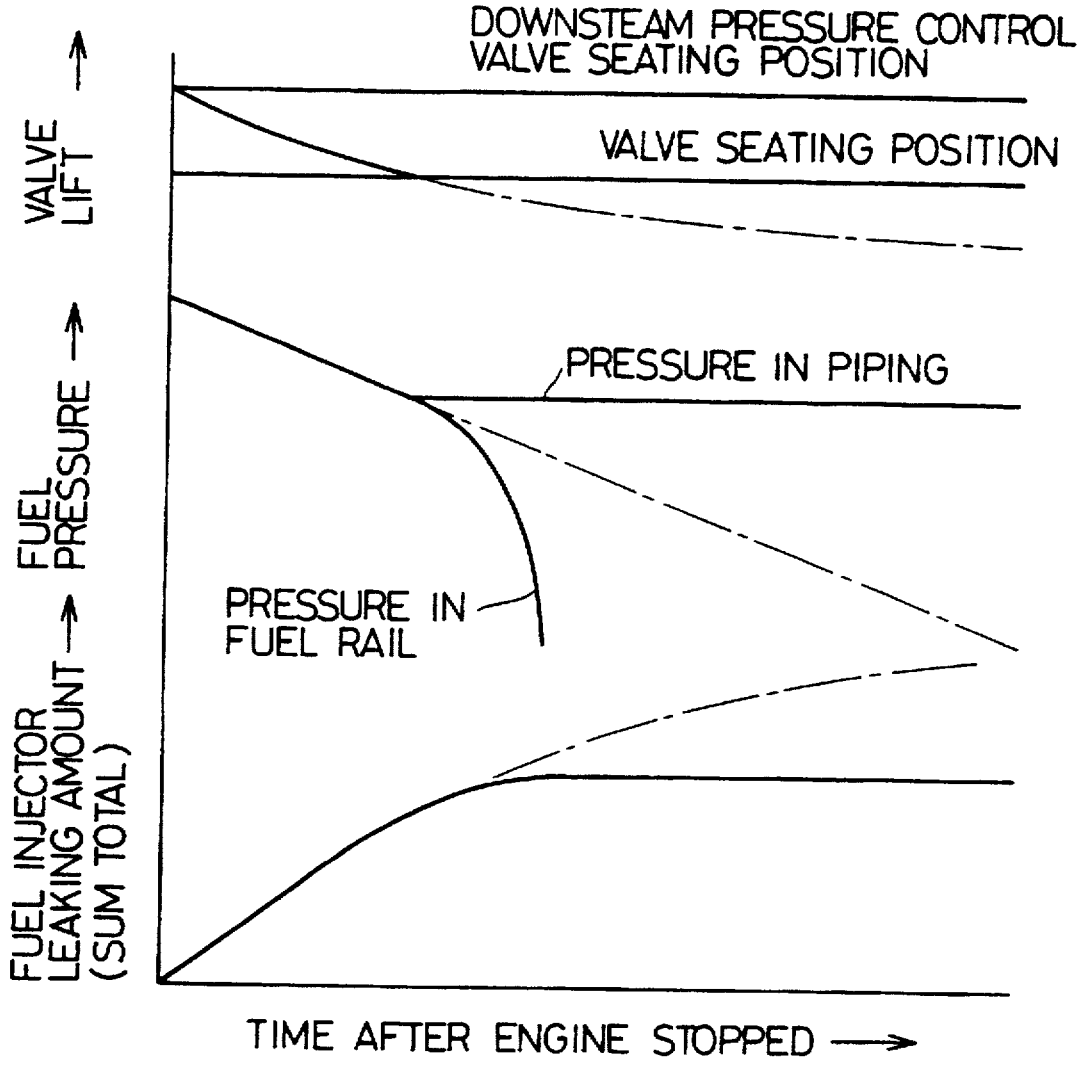
FIG. 6 is a graph showing the change of a lifted amount of the opening-closing valve, a fuel pressure and leaking fuel amount of a fuel injector with time after stopping the engine in the first embodiment.

However, since the fuel is in a high pressure state, the fuel is gradually leaked from the fuel injector 17 toward the intake port as shown in FIG. 6. Thus, the pressure of fuel in the fuel rail 15 is gradually decreased.

When the pressure of fuel in the fuel rail 15 is lowered (that is, the pressure of fuel in the diaphragm lower room 68 is lowered), since the pressure of fuel in diaphragm upper room 69 becomes larger than that of fuel in diaphragm lower room 68, the diaphragm 60 and the valve presser 58 are gradually lowered, whereby the valve members 51 and 36*a* are also lowered as shown by the graph of the lifted amount of the valve in FIG. 6. By such downward movement, the passage of fuel is closed when the valve member 36*a* of the opening-closing valve 36 reaches the opening-closing valve seat position. Therefore, the fuel rail 15 at the downstream side of the opening-closing valve 36 and the fuel pipe 11 at the upstream side of the opening-closing valve 36 are separated.

Then, the fuel in the fuel rail 15 is leaked from the fuel injector 17, so that the pressure of fuel in the fuel rail 15 is rapidly lowered as shown by the graph of fuel pressure in FIG. 6. On the other hand, the fuel in the fuel pipes 7 and 11 is closed between the check valve of the fuel pump 3 and the opening-closing valve 36, and therefore, the pressure in the fuel pipes 7 and 11 keeps a constant value after being closed.

In FIG. 6, the graph shown by the chain line shows a comparison example when the fuel passage is closed by the check valve of the fuel pump 3 but is not closed by the opening-closing valve 36.

Next, when the operation of the engine is restarted, the fuel pump 3 is operated and the check valve is opened, and therefore, high pressure fuel is supplied to the fuel pipes 7 and 11. Thus, the relief valve 37 is opened, the fuel is supplied to the fuel rail 15, and the fuel can be injected.

In the first embodiment, the opening pressure of the relief valve 37 is so set as not to be opened by the pressure of fuel closed in the fuel pipes 7 and 11 at the stop of the fuel pump 3 but as to be opened by the pressure of fuel supplied from the fuel pump 3.

Further, when fuel is supplied from the relief valve 37, the pressure of the diaphragm lower room 68 is increased by the pressure of fuel, the diaphragm 60 is pressed, the valve members 51 and 36*a* rise, and the fuel passage is opened within the downstream pressure control valve 35. Then, the control of fuel pressure is restarted by the downstream control valve 35.

Next, experimental examples for confirming the effects of the first embodiment will be described.

An experimental example for showing the reduced effect for reducing HC amount in the exhaust gas will be described.

In the experiment, by using the fuel supply apparatus of the first embodiment and a comparison system which is equipped with the check valve of the fuel pump 3 but without the opening-closing valve 36, the relationship between leaking fuel amount from the fuel injector 17 and HC amount in the exhaust gas is obtained. The results are shown in FIG. 7.

Figure 7:
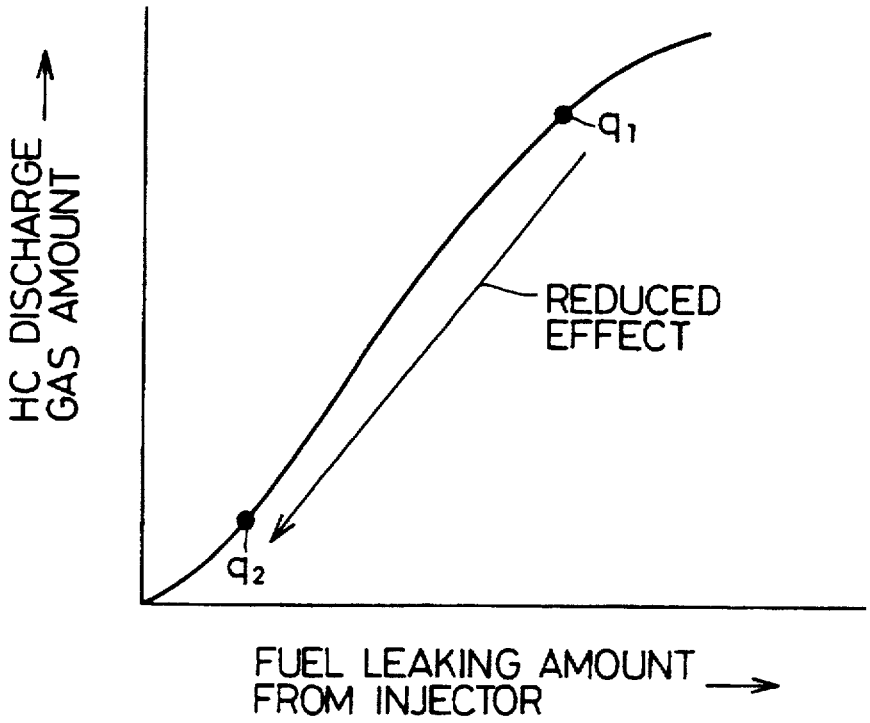
FIG. 7 is a graph showing a reduced effect of HC exhaust gas amount in the first embodiment.

As shown in FIG. 7, in the fuel supply apparatus of the first embodiment, a preferable result, in which leaking fuel amount from the fuel injector 17 is small, so that exhausted HC amount is also small (q2), is obtained. However, in the comparing example system, leaking fuel amount from the fuel injector 17 is large, so that exhausted HC amount is also large (q1).

An experimental example for showing the reduced effect for reducing the starting time will be described.

In the experiment, by using the fuel supply apparatus of the first embodiment and a comparison system which is equipped with the check valve of the fuel pump 3 but without the opening-closing valve 36, the state of the fuel pressure in the fuel rail 15 and complete explosion time (time until normal combustion is performed) are examined according to the time passage after supplying an electric power to the starter of the engine (after the starter is turned on). The result is shown in FIG. 8.

Figure 8:
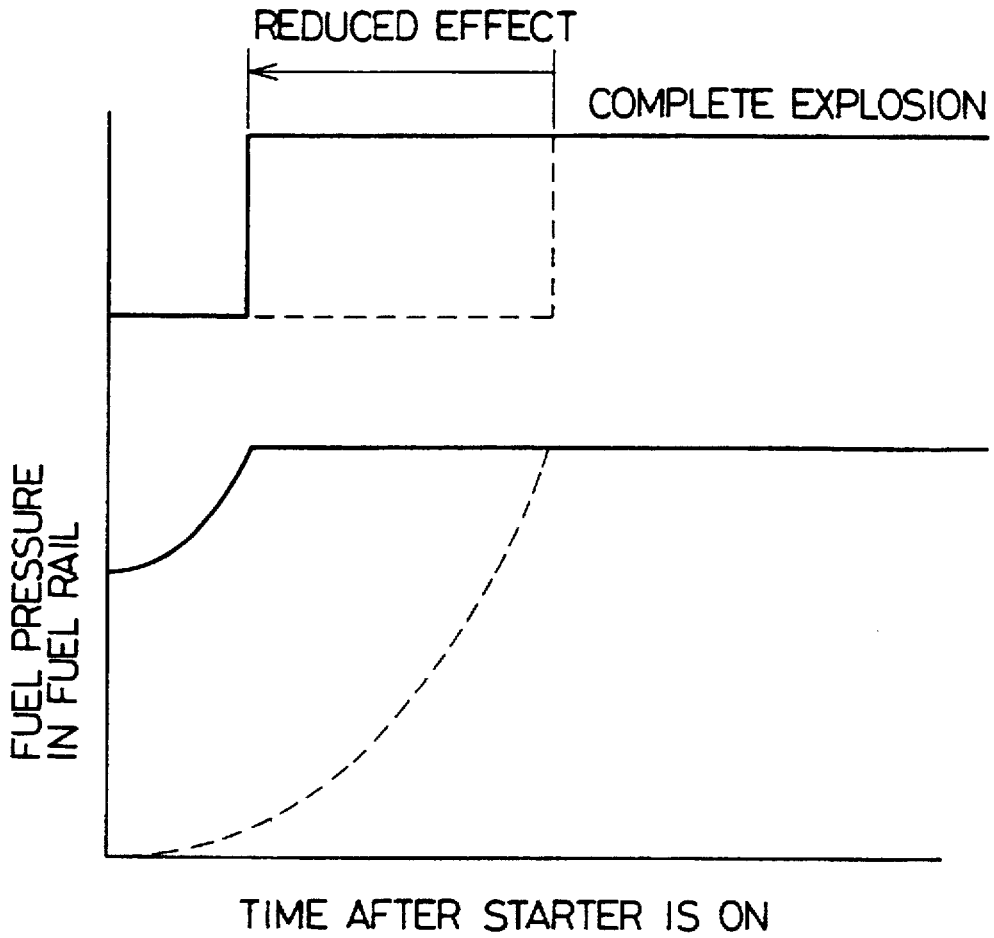
FIG. 8 is a graph showing a reduced effect of starting time in the first embodiment.

As shown in FIG. 8, in the fuel supply apparatus of the first embodiment (shown by the solid line), because the opening-closing valve 36 is provided, even though fuel is leaked from the fuel injector 17, the leaking amount becomes small (part in the fuel rail 15). Thus, a preferable result, in which fuel is filled in the fuel rail 15 and the pressure of the fuel rail 15 reaches a predetermined fuel pressure with a little time after starter is turned on, so that complete explosion can be performed quickly. However, in the comparison system (dotted line), because the opening-closing valve 36 is not provided, the leaking amount becomes large (part in the fuel rail 15 and in the fuel pipes 7 and 11). Accordingly, it takes long time after the starter is turned on for pressure of fuel in the fuel rail 15 to reach a predetermined value, and then the complete explosion is performed, thus deteriorating the startability.

As described above, in the first embodiment, since the side of the fuel rail 15 and the side of the fuel pipes 7 and 11 are separated by the opening-closing valve 36 when the engine is stopped. Therefore, even when the fuel is leaked from the injector 17, the leaking amount corresponds to a fuel amount on a downstream side of the opening-closing valve 36 (including the fuel rail 15), and the leaking amount is very small compared with conventional systems. Thus, the amount of exhausted HC gas is decreased when the engine is restarted and emissions in the exhaust gas are greatly decreased.

Further, when the engine is stopped, the check valve of fuel pump 3 closes the fuel passage at the stop of fuel pump 3 and fuel is held in the fuel pipes 7 and 11 between the check valve and the opening-closing valve 36. Thus, when the engine is restarted, since fuel is quickly supplied to the fuel rail 15, starting performance is improved.

A second embodiment of the present invention will be described.

In the second embodiment, the structure of the pressure control valve is different from that in the first embodiment. An electromagnetic valve is used as the opening-closing valve. In the second embodiment, components identical or equivalent to those in the first embodiment are shown with the same reference numerals and the related explanation is omitted or simplified.

Figure 9:
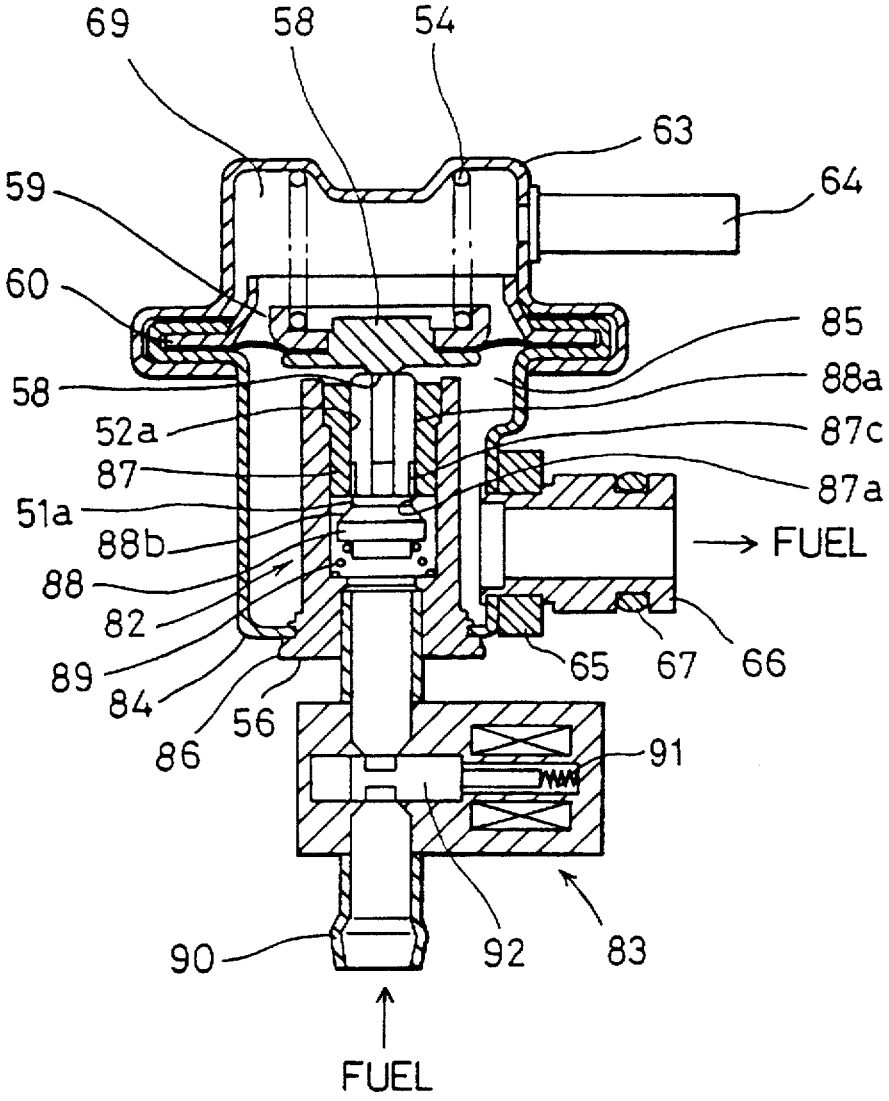
FIG. 9 is a cross sectional view of a pressure control valve in a second embodiment.

As shown in FIG. 9, a pressure control valve 82 of the second embodiment is different from the pressure control valve 13 of the first embodiment in that the opening-closing valve 36 and the relief valve 37 are not provided and the electromagnetic valve 83 is disposed on an upstream side of a downstream pressure control valve 82.

In the pressure control valve 82 of the second embodiment, a cylindrical connector 86 is held within a diaphragm lower room 85 formed in a body 84. A cylindrical valve body 87 and a valve member 88 having an inside guide **88*a* which is slidable in the valve body 87 are accommodated in the connector 86**.

The valve member 88 is biased in the valve closing direction (the upper direction in FIG. 9) by a compression coil spring 89, taper shaped contacting portion **88*b* of the valve member 88 is contacted with a valve seat 87*a* of the valve body 87. The cross section of the inside guide 88*a* in radial direction is formed in a cross shape. Further, a recess portion 87*c* is formed in a lower portion of the inside guide 88*a***.

In the second embodiment, the downstream pressure control valve 82 is constituted as the above, more specifically, the electromagnetic valve 83 which is driven by the signals from the electronic control unit (ECU) and opens or closes fuel passage is located in a pipe 90 at an upstream side of the downstream pressure control valve 82.

When the engine is stopped, electric power is not supplied to the electromagnetic valve 83, and therefore the fuel passage is closed by the spring force of the compression coil spring 91. When the engine is started, electric power is supplied to the electromagnetic valve 83, and therefore a valve member 92 is moved by the attracting force of a solenoid so that the fuel passage is opened.

Next, an operation of the pressure control valve 82 will be described.

Firstly, when the pressure of fuel at the side of the fuel rail 15 is lower than a setting pressure of the downstream pressure control valve 82, similarly to that of the first embodiment, the valve member 88 is moved downwardly in FIG. 9 by a pressure balance, and therefore the downstream pressure control valve 82 is opened.

Further, when the pressure of fuel on the side of the fuel rail 15 is increased to a setting pressure of the downstream pressure control valve 82, similarly to that of the first embodiment, the valve member 88 is moved upwardly in FIG. 9, and therefore the downstream pressure control valve 82 is closed.

Next, in this state, when the engine is stopped, the fuel pump 3 stops and the check valve of the fuel pump 3 closes the fuel passage. Further, when the engine is stopped, electric power is not supplied to the electromagnetic valve 83, so that the fuel passage is closed in the pipe 90. Thus, by the electromagnetic valve 83, the side of the fuel rail 15 and the side of the fuel pipe 11 are separated.

Then, in the same manner as in FIG. 6, fuel in the fuel rail 15 is leaked from the fuel injector 17, so that the pressure of fuel in the fuel rail 15 is rapidly decreased. In accordance with the decrease in the pressure of the fuel, the valve member 88 of the downstream pressure control valve 82 is moved downwardly in FIG. 9 so as to be opened. The fuel within the fuel pipes 7 and 11 is captured between the check valve of the fuel pump 3 and the electromagnetic valve 83, and therefore the pressure within the fuel pipes 7 and 11 keeps a constant pressure after being closed.

Next, when the operation of the engine is restarted, the fuel pump 3 is operated and its check valve is opened, and therefore high pressure fuel is supplied to fuel pipes 7 and 11. At the same time, electric power is re-supplied to the electromagnetic valve 83, whereby the fuel passage is opened. Thus, fuel is supplied to the fuel rail 15 through the downstream pressure control valve 82, and the fuel can be injected.

Next, a control process in the second embodiment will be described with reference to FIG. 10.

Firstly, when the engine is stopped, the process will be described.

Figure 10:
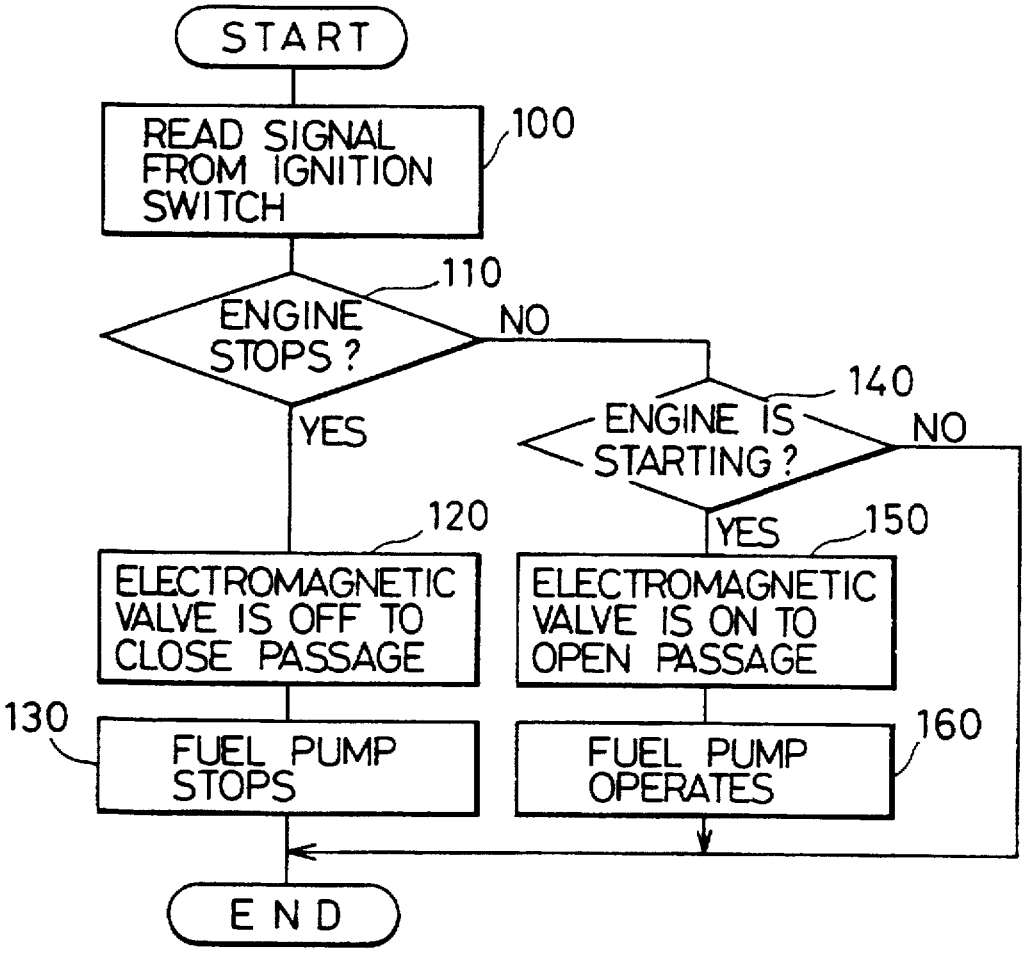
FIG. 10 is a flow chart showing a control process in the second embodiment.

As shown in FIG. 10, in the step 100, the electronic control unit (ECU) reads signals from an ignition switch 33.

In the step 110, it is determined whether or not the ignition key is in a stop position based on the signal from the ignition switch 33. When the determination is YES in the step 110, it proceeds to step 120. When the determination is NO, it proceeds to step 140.

In the step 120, since it is determined that the engine is stopped, a control signal of stopping the electric power of the electromagnetic valve 83 is output by an electromagnetic valve control circuit (not shown), the fuel passage is closed, so that the side of the fuel rail 15 and the side of the fuel pipes 7 and 11 are separated by the electromagnetic valve 83.

Then, in step 130, a control signal is output to the constant current type control circuit 23, so that the current is not supplied to the direct current electric power motor of the fuel pump 3, and the process is temporarily ended.

Secondly, the process when the engine is starting will be described. In the step 110, it is determined that the engine is not in stopping, it proceeds to step 140. In the step 140, it is determined whether or not the ignition key is in a starting position based on the signal from the ignition switch 33. When the determination is YES in the step 140, it proceeds to step 150. When the determination is NO, the process is temporarily ended.

In the step 150, since it is determined that the engine is in starting, a control signal for supplying the electric power to the electromagnetic valve 83 is output by an electromagnetic valve control circuit (not shown), the fuel passage leading to the fuel rail 15 is opened.

Then, in step 160, a control signal is output to the constant current type control circuit 23, so that the current is supplied to the direct current electric power motor of the fuel pump 3, and the process is temporarily ended.

As described above, in the second embodiment, when the engine is stopped, the side of the fuel rail 15 and the side of the fuel pipes 7 and 11 side are separated by the electromagnetic valve 83, and therefore, the leaking amount of fuel from the fuel injector 17 can be decreased. Thus, the discharge amount of HC gas is decreased in re-starting, and emissions in the exhaust gas can be greatly decreased.

Further, when the engine is stopped, the check valve of the fuel pump 3 closes the fuel passage, the fuel pump 3 stops and, fuel is therefore held between the pump check valve and the electromagnetic valve 83. Thus, when the engine is restarted, fuel is quickly supplied to the fuel rail 15, and startability is improved.

In the second embodiment, since the relief valve may be omitted, the structure is simplified. However, in the same manner as the first embodiment, the relief valves may be provided to perform a more reliable operation.

The present invention should not be restricted to the above described embodiments but may be modified in many other ways without departing from the spirit of the invention.

For example, in the above-described embodiments, as the fuel pump, the direct current electric power motor is used, and the method for controlling the current value is used. However, it is not restricted to the method for controlling the current value, various methods including a method for controlling the voltage to a predetermined value, a method for controlling the rotational speed by a current motor, a step motor or the like, and further, a method for relieving fuel from the fuel pipe by operating the fuel pump with a constant value, may be used.

Although the present invention has been fully described in connection with the preferred embodiments thereof with reference to the accompanying drawings, it is to be noted that various changes and modifications will become apparent to those skilled in the art. Such changes and modifications are to be understood as being included within the scope of the present invention as defined in the appended claims.

What is claimed is:

1. A method of controlling a fuel supply system for an internal combustion engine, said method comprising:

pumping fuel into a first end of a fuel supply passage to a fuel injector supply rail fed via the opposite second end of the passage;

automatically closing said second end of said passage to reduce fuel leakage from said rail under stopped engine conditions, including closure of an on-off valve in response to reduced fuel pressure in said rail;

trapping pressurized fuel within the fuel supply passage when said on-off valve is closed; and regulating fuel pressure downstream of said on-off valve using a pressure-regulating valve that is also disposed to control actuation of said on-off valve.

2. A method as in claim 1 further comprising:

by-passing fuel around said pressure regulator to the fuel supply rail in response to a predetermined pumped fuel pressure upon engine re-start thus more quickly re-establishing pressurized fuel in the supply rail upon engine start-up.

3. A fuel supply system for an internal combustion engine, said system comprising:

a fuel pump having a fuel discharge port connected to a first end of a fuel supply passage;

a controllable on-off valve disposed at an opposite second end of said passage;

a fuel injector supply rail connected to receive fuel via said on-off valve;

shut-off means for automatically turning said valve off to reduce fuel leakage wherein said shut-off means comprises means for automatically closing said valve in response to reduced fuel pressure in said rail; and a fuel pressure regulator coupled downstream of said on-off valve and having a pressure-regulating valve that is also disposed to control actuation of said on-off valve.

4. A fuel supply apparatus as in claim 3 further comprising:

an electric motor for driving said fuel pump; and an electric control unit for controlling an electric current supplied to said electric motor to a predetermined value.

5. A fuel supply apparatus as in claim 3 wherein:

said pressure control valve includes a valve member, and said opening-closing valve is integrally formed with said valve member of said pressure control valve.

6. A fuel supply apparatus as in claim 3 further comprising:

a relief valve for releasing pressure of fuel from said upstream side to said downstream side.

7. A fuel supply apparatus as in claim 4 wherein:

said relief valve is disposed in a fuel passage bypassing said pressure control valve.

8. A fuel supply apparatus as in claim 4 wherein:

said opening-closing valve is opened when the pressure of fuel introduced into said downstream side through said relief valve reaches a predetermined value.

9. A fuel supply system as in claim 3 wherein:

said on-off valve is electromagnetically actuated and said shut-off means comprises an electrical control circuit connected to detect an engine stopped condition.

10. A fuel supply system as in claim 3 further comprising:

a one-way flow control check valve installed proximate said pump and said first end of the fuel supply passage to trap pressurized fuel within the fuel supply passage when said on-off valve is closed.

11. A fuel supply system as in claim 10 wherein:

said shut-off means comprises means for automatically closing said on-off valve in response to reduced fuel pressure in said rail.

12. A fuel supply system as in claim 11 further comprising:

a fuel pressure regulator coupled downstream of said on-off valve and having a pressure-regulating valve that is also disposed to control actuation of said on-off valve.

13. A fuel supply system as in claim 12 further comprising:

a one-way pressure-actuated flow control valve disposed to by-pass said pressure regulator thus more quickly re-establishing pressurized fuel in the supply rail upon engine start-up.

14. A method of controlling a fuel supply system for an internal combustion engine, said method comprising:

pumping fuel into a first end of a fuel supply passage to a fuel injector supply rail fed via the opposite second end of said passage;

automatically closing said second end of said passage to reduce fuel leakage from said rail under stopped engine conditions, including closure of an on-off valve in response to reduced fuel pressure in said rail; and regulating fuel pressure downstream of said on-off valve using a pressure-regulating valve that is also disposed to control actuation of said on-off valve.

15. A method as in claim 14 wherein:

said automatically closing step comprises detecting an engine stopped condition and generating an electrical control current to an electromagnetically actuated on-off valve.

* * * * *